United States Patent [19]

Hirata et al.

[11] Patent Number: 4,857,686

[45] Date of Patent: Aug. 15, 1989

[54] MICROWAVE OVEN WITH HEATING CHAMBER TEMPERATURE DETECTING CIRCUIT

[75] Inventors: Kengo Hirata, Nara; Katsumi Ishifuro, Yao, both of Japan

[73] Assignee: Sharp Kabushiki Kaisha, Osaka, Japan

[21] Appl. No.: 271,392

[22] Filed: Nov. 15, 1988

Related U.S. Application Data

[63] Continuation of Ser. No. 108,961, Oct. 16, 1987, abandoned.

[30] Foreign Application Priority Data

Jan. 23, 1987 [JP] Japan ..... 62-14454

[51] Int. Cl.[4] ..... H05B 6/68

[52] U.S. Cl. ..... 219/10.55 B; 219/10.55 M; 219/494; 219/510; 99/325; 374/149

[58] Field of Search ..... 219/10.55 B, 10.55 E, 219/10.55 R, 510, 511, 516, 494, 508, 515; 99/325; 374/149

[56] References Cited

U.S. PATENT DOCUMENTS

| | | | |
|---|---|---|---|
| 4,093,841 | 6/1978 | Dills | 219/10.55 E |
| 4,220,840 | 9/1980 | Barker | 219/10.55 B |
| 4,266,118 | 5/1981 | Takase et al. | 219/10.55 B |
| 4,309,584 | 1/1982 | Terakami | 219/10.55 B |
| 4,350,858 | 9/1982 | Yoshida | 219/10.55 B |
| 4,469,926 | 9/1984 | Komuro | 219/10.55 B |
| 4,568,810 | 2/1986 | Carmean | 219/10.55 B |

FOREIGN PATENT DOCUMENTS

| | | |
|---|---|---|
| 3226938 | 4/1983 | Fed. Rep. of Germany . |
| 2037100 | 7/1980 | United Kingdom . |
| 2096417 | 10/1982 | United Kingdom . |

*Primary Examiner*—Philip H. Leung

*Attorney, Agent, or Firm*—Birch, Stewart, Kolasch, & Birch

[57] ABSTRACT

In a circuit for detecting the heating chamber temperature in a microwave oven, a switching transistor is connected in series or parallel with a heating chamber temperature detecting thermistor. If and when the heating chamber temperature need not be detected, the switching transistor is turned on when the switching transistor and thermistor are connected in parallel and off when the switching transistor and thermistor are connected in series to consequently prevent corrosion of the terminals of such thermistor.

7 Claims, 2 Drawing Sheets

MICROWAVE OVEN WITH HEATING CHAMBER TEMPERATURE DETECTING CIRCUIT

This application is a continuation of application Ser. No. 108,961 filed on Oct. 16, 1987, now abandoned.

BACKGROUND OF THE INVENTION

The present invention relates to a microwave oven and, more particularly, to a circuit and a method for preventing corrosion of terminals of a heating chamber temperature detecting thermistor employed in a multifunctional microwave oven having a heater cooking function, microwave heating function and so forth.

In the microwave oven equipped with oven cooking functions, a heating chamber temperature detecting thermistor is furnished for maintaining its internal heating chamber at a predetermined temperature. However, a problem occurs when steam generated from food in a microwave heating mode deposits in the form of water droplets on the thermistor.

It has been customary heretofore that such microwave ovens adopts a circuit configuration where a voltage is applied continuously between the two terminals of the thermistor.

Accordingly, a problem exists in the related art that the terminals of the thermistor are electrolytically corroded before finally being broken.

SUMMARY OF THE INVENTION

In an attempt to eliminate the drawback mentioned, it is an object of the present invention to provide an improved heating chamber temperature detecting circuit in a microwave oven having a circuit to prevent corrosion of the terminals of a heating chamber temperature detecting thermistor.

The present invention has been accomplished in view of the fact that corrosion of the thermistor terminals is induced electrolytically. The feature resides in preventing such electrolytic corrosion by interrupting the application of a voltage between the thermistor terminals when the heating chamber temperature is not needed to be detected by the thermistor.

Other objects and further scope of applicability of the present invention will become apparent from the detailed description given hereinafter. It should be understood however, that the detailed description and specific examples, while indicating preferred embodiments of the invention, are given by way of illustration only, since various changes and modifications within the spirit and scope of the invention will become apparent to those skilled in the art from this detailed description.

To achieve the above, according to an embodiment of the present invention, the heating chamber temperature detecting circuit in a microwave oven comprises a thermistor that detects the temperature in the heating chamber, and a switching means connected in series or parallel with the thermistor and is turned on or off in accordance with the detection of the heating chamber temperature.

As described, the switching means is connected in series or parallel with the heating chamber temperature detecting thermistor, and such means is turned on or off when it is not necessary to detect the heating chamber temperature.

In case the heating chamber temperature is not needed to be detected by the thermistor, no voltage is applied between the two terminals of the thermistor, so that when detection of such temperature by the thermistor is required (generally in a heater cooking mode), no water droplets are deposited on the thermistor to consequently avert electrolytic corrosion of its terminals.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Hereinafter a heating chamber temperature measuring circuit in a first embodiment of the present invention will be described with reference to FIGS. 1 through 3.

Figure 1:
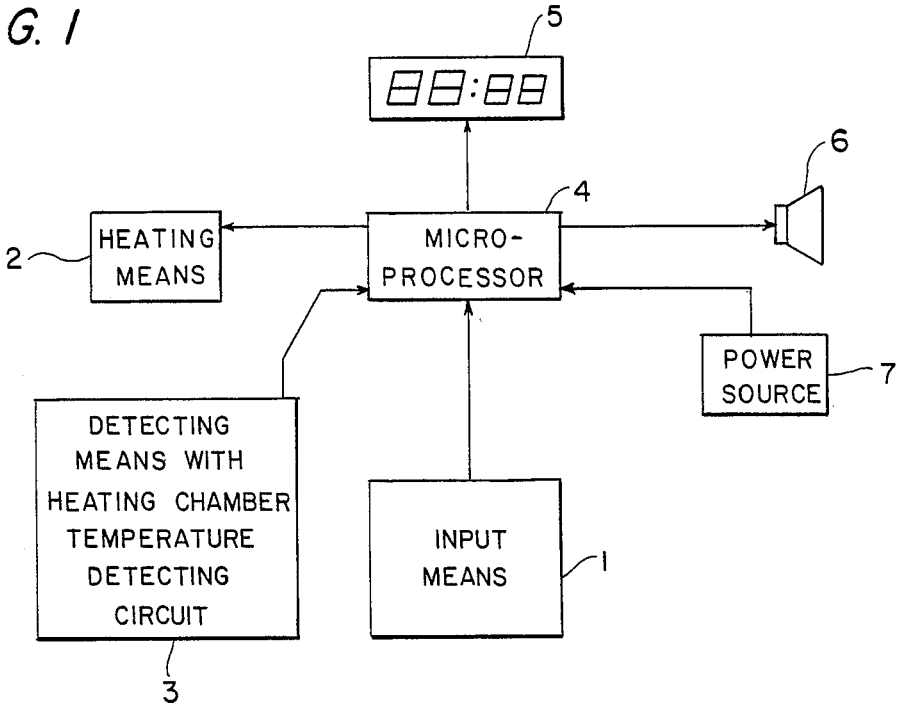
FIG. 1 is a schematic block diagram of a microwave oven employing a heating chamber temperature measuring circuit of the present invention.

FIG. 1 is a schematic block diagram of a microwave oven employing the heating chamber temperature measuring circuit of the invention; FIG. 2 is a connection diagram of a heating chamber temperature detecting circuit according to the invention; and FIG. 3 is a flow chart of the operation relative to the invention.

In FIG. 1, an input means 1 comprises numeral keys for inputting a heating duration, a present time and so forth, and a plurality of function keys for selecting desired functions such as a heater cooking mode, a microwave heating mode, a thawing mode and so forth. A heating energy generating means 2 comprises, for example, a heater and/or a magnetron capable of generating microwaves. A detecting means 3 serves to detect the temperature or humidity in the heating chamber and includes the heating chamber temperature detecting circuit of the present invention. Also are a microprocessor 4 for controlling the entire operations of the microwave oven; a display means 5 for displaying the time, temperature and so forth; an informing means 6 for producing a buzzer or vocal output to inform a user of start, end and procedure of desired cooking; and a power source 7 for supplying a required power to the microprocessor 4.

Figure 2:
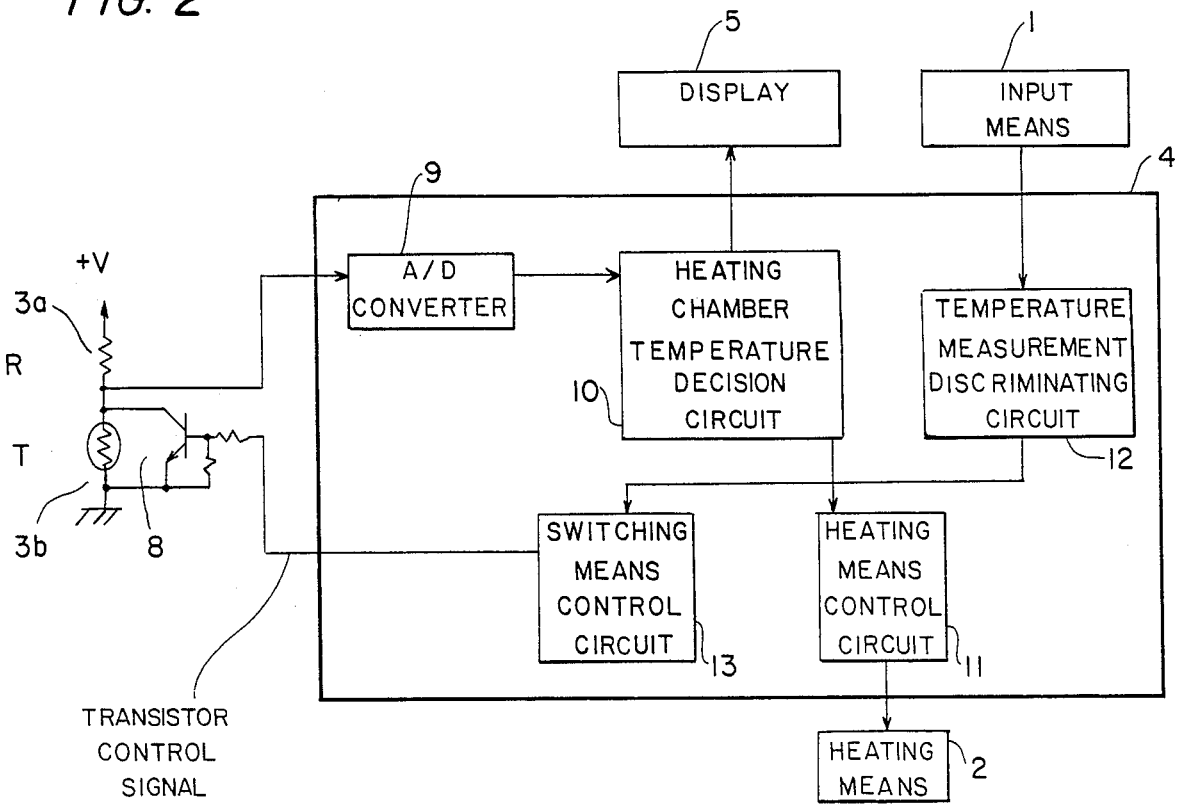
FIG. 2 is a connection diagram of a heating chamber temperature detecting circuit in a first embodiment of the invention.
Figure 3:
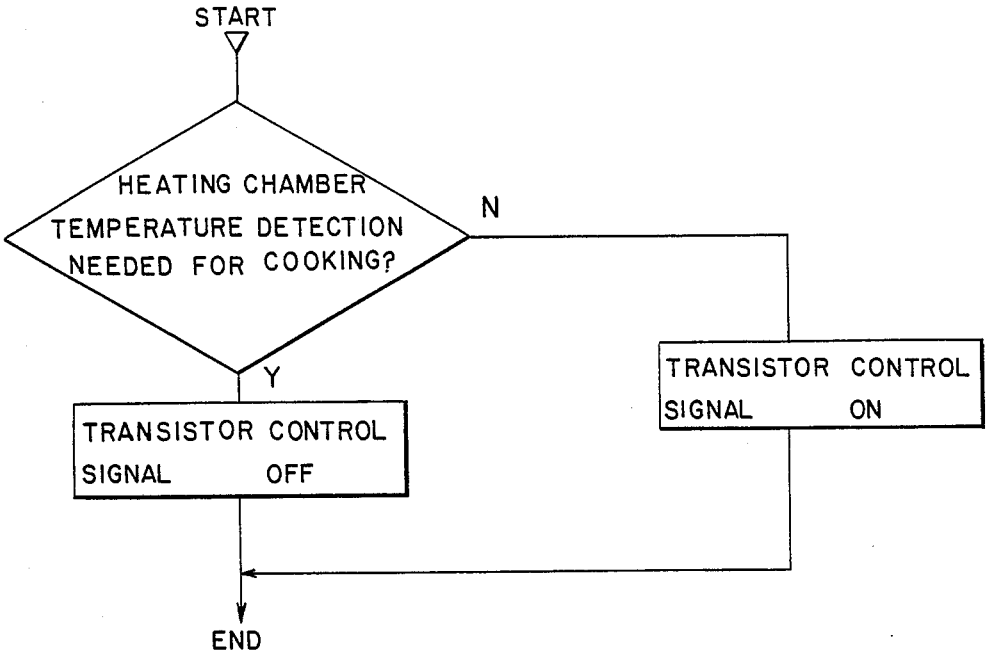
FIG. 3 is a flow chart of the operation relative to the present invention.

In FIG. 2, further shown are a resistor 3*a* (R) and a thermistor 3*b* (T) constituting a heating chamber temperature detecting circuit, and an NPN switching transistor 8 of which the collector and emitter are connected between the terminals of the thermistor 3*b* in such a manner that the transistor 8 is turned on or off by the microprocessor 4. The microprocessor 4 comprises an A/D converter 9 for converting the voltage generated between the two terminals of the temperature detecting thermistor 3*b* into a digital signal in proportion to the heating chamber temperature, a heating chamber temperature decision circuit 10 for determining the heating chamber temperature from the digital signal obtained from the A/D converter 9, a heating control circuit 11 for maintaining the heating means in its optimal state under control in accordance with the heating chamber temperature determined by the circuit 10, a temperature measurement discriminating circuit 12 responsive to the input fed from the key input means 1 and discriminating whether detection of the heating chamber temperature is necessary or not in the present heating mode, and a switching means control circuit 13 for controllably turning on or off the switching transistor 8 used as a switch means.

This embodiment is so contrived that temperature detection is executed when any of heater cooking modes including convection cooking, grill cooking (toaster cooking) and so forth, is selected by the key input means 1, but such temperature detection is not executed when a microwave heating mode is selected by the key input means 1. Also, the operation is performed so as not to detect the temperature during a cooking standby period such as interruption of the heating.

Although the key input means 1 is used to feed an instruction for deciding whether to execute detection of the heating chamber temperature, a key may be furnished for inputting an instruction whenever the user decides that temperature detection is not necessary or a key for inputting such instruction when temperature detection is necessary.

Hereinafter the operation of the present invention will be described with reference to the flow chart of FIG. 3. If any heater cooking mode requiring detection of the heating chamber temperature such as convection cooking, grill cooking (toaster cooking) or the like is selected by the input means 1, a control signal for turning off the transistor 8 is outputted from the microprocessor 4, so that a voltage corresponding to the heating chamber temperature is generated between the two terminals of the thermistor **3*b*. As the voltage generated is inputted to the microprocessor 4, the heating chamber temperature is detected to control the desired cooking. In such heater cooking mode, the periphery of the thermistor 3*b* is heated up to a high temperature by the thermal energy from the heater, so that no water droplets are deposited on the thermistor 3*b***.

Meanwhile, when detection of the heating chamber temperature is not needed such as in a microwave heating mode or a cooking standby state, a control signal for turning on the transistor 8 is outputted from the microprocessor 4, and then the two terminals of the thermistor **3*b* are thereby short-circuited so that no voltage is applied between the terminals. Consequently, electrolytic corrosion thereof can be prevented from advancing despite the existence of any water droplets between the terminals of the thermistor 3*b***.

Figure 4:
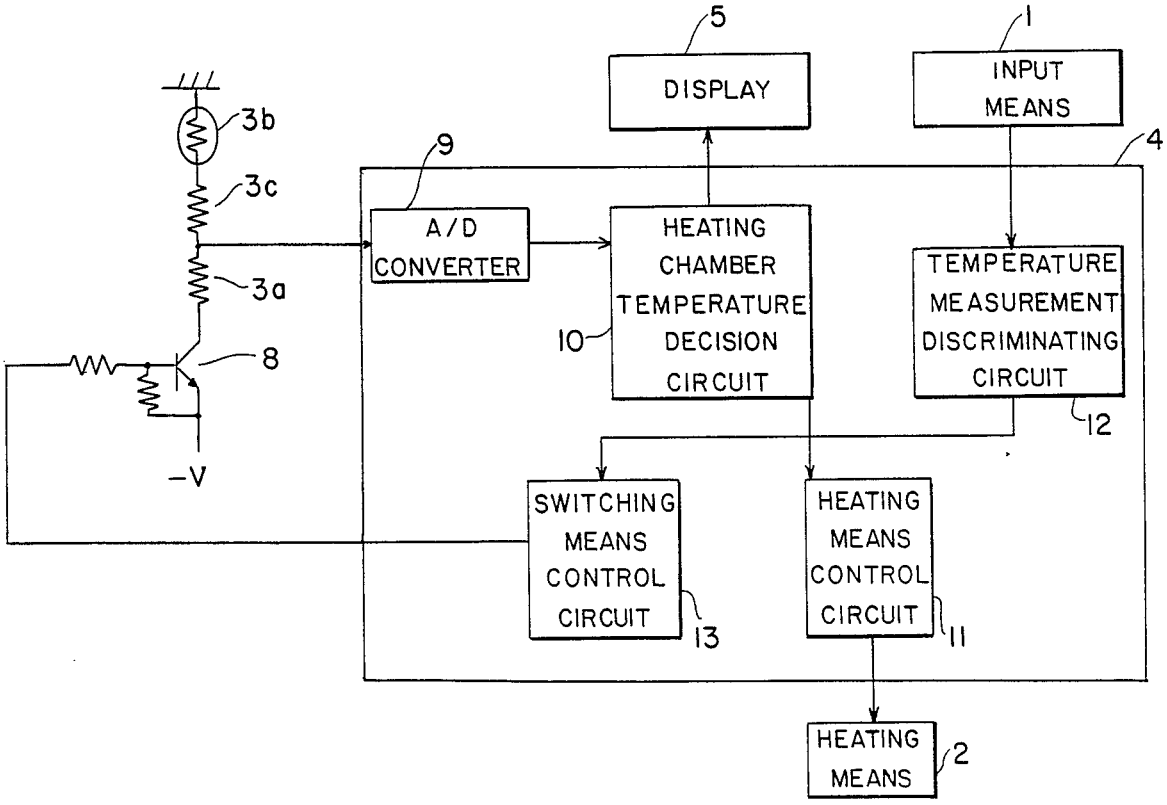
FIG. 4 is a connection diagram of a heating chamber temperature detecting circuit in a second embodiment of the invention.

In the heating chamber temperature detecting circuit mentioned above, the transistor 8 is connected in parallel with the thermistor **3*b*. However, in a modified circuit configuration, the transistor 8 may be connected in series with the thermistor 3*b* in such a manner as to be turned on when detection of the heating chamber temperature is necessary or to be turned off when such detection is not necessary. An exemplary modification is shown in FIG. 4, wherein a resistor 3*c* is inserted between the thermistor 3*a* and the resistor 3*b*. Furthermore, differing from the first and second embodiments in which the thermistor 3*b* is controlled by the transistor 8** as a switching means, manual control of the switching means may also be effected.

As described hereinabove, in the improved heating chamber temperature detecting circuit of the present invention designed for use in a microwave oven, a switching means connected in series or parallel with a heating chamber temperature detecting thermistor is turned on or off when detection of the heating chamber temperture is not necessary, thereby preventing electrolytic corrosion of the terminals of the temperature detecting thermistor.

Thus, according to the present invention, it becomes possible to attain a low-cost prevention of the electrolytic corrosion that may otherwise be caused in the terminals of the heating chamber temperature detecting thermistor.

While only certain embodiments of the present invention have been described, it will be apparent to those skilled in the art that various changes and modifications may be made therein without departing from the spirit and scope of the present invention as claimed.

What is claimed is:

1. An electronically controlled cooking system, comprising:

heating chamber means for providing a place for performing a plurality of cooking operations on an item to be cooked;

cooking source means, operatively communicating with said heating chamber means, for conducting said plurality of cooking operations within said heating chamber;

a heating chamber thermistor, operatively connected to said heating chamber means, for selectively detecting temperature in said heating chamber means;

input means, operatively communicating with said cooking source means, for selecting one of said plurality of cooking operations, some of said plurality of cooking operations being performed by said cooking source means without detecting temperature by said heating chamber thermistor; and corrosion prevention means for preventing corrosion of said heating chamber thermistor by selectively disconnecting said heating chamber thermistor from detecting temperature in response to detecting one of said plurality of cooking operations which does not require detecting temperature by said heating chamber thermistor to avoid unnecessary temperature detection and associated corrosion of said heating chamber thermsistor.

2. The cooking system as defined in claim 1, wherein said corrosion prevention means is connected in series with said heating chamber thermistor.

3. The cooking system as defined in claim 2, wherein said corrosion prevention means is a transistor.

4. The cooking system as defined in claim 1, wherein said cooking source means comprises:

a heater energizing source and a microwave generating source, wherein said corrosion prevention means connects said heating chamber thermistor to detect temperature during energization of the heater energizing source and disconnects said heating chamber thermistor to not detect temperature during energization of the microwave generating source.

5. The cooking system as defined in claim 1, further including a control panel with a plurality of keys arrayed thereon, wherein at least one of said keys is used for selectively turning on or off said corrosion prevention means.

6. A method of preventing corrosion of terminals of a heating chamber thermistor provided within a heating chamber of a cooking system for monitoring the temperature thereof, which comprises:

connecting switching means in series with said heating chamber thermistor; and preventing corrosion of said heating chamber thermistor terminals by turning off said switching means to discontinue voltage application to said heating chamber thermistor, when the temperture in the heating chamber does not need to be detected.

7. A method of preventing corrosion of terminals of a temperature detecting thermistor provided within a heating chamber of a cooking system for monitoring the temperature thereof which comprises:

connecting switching means in parallel with said heating chamber thermistor; and preventing corrosion of said heating chamber thermistor terminals by turning on said switching means to discontinue voltage application to said heating chamber thermistor when the temperature in the heating chamber does not need to be detected.

* * * * *